US005103508A

United States Patent [19]

Counts

[11] Patent Number: 5,103,508

[45] Date of Patent: Apr. 14, 1992

[54] WATER WALKER

[76] Inventor: Clarice R. Counts, 6402 Guilford Rd., Clarksville, Md. 21029

[21] Appl. No.: 627,088

[22] Filed: Dec. 12, 1990

[51] Int. Cl.[5] ..... H47K 3/602; A63B 17/00; E04H 4/14

[52] U.S. Cl. ..... 4/494; 4/507; 482/55; 482/51; 482/111

[58] Field of Search ..... 4/506, 507, 496, 494, 4/487, 511, 513, 582, 488; 52/169.7, 109; 220/9.2, 401, 403; 272/71, 69, 65, 70

[56] References Cited

U.S. PATENT DOCUMENTS

| | | | |
|---|---|---|---|
| 92,364 | 7/1869 | Rider . | |
| 618,442 | 1/1899 | Shearer . | |
| 1,075,912 | 10/1913 | Helli . | |
| 3,799,228 | 3/1974 | Crawford | 220/9.2 X |
| 4,264,991 | 5/1981 | Lasalandra . | |
| 4,383,564 | 5/1983 | Hoie | 4/506 X |
| 4,776,581 | 10/1988 | Shepherdson | 272/71 X |
| 4,860,914 | 8/1989 | Derni et al. . | |
| 4,948,118 | 8/1990 | Miraglia | 272/71 |
| 4,956,882 | 9/1990 | Cohn, III | 4/511 X |
| 5,016,296 | 5/1991 | Beaumont | 4/496 |

FOREIGN PATENT DOCUMENTS

| | | | |
|---|---|---|---|
| 537401 | 11/1931 | Fed. Rep. of Germany | 220/9.2 |
| 57175 | 9/1911 | Switzerland | 220/9.2 |

*Primary Examiner*—Daniel M. Yasich
*Attorney, Agent, or Firm*—Longacre & White

[57] ABSTRACT

The water walker is a collapsible exercise device with a waterproof liner supported by an external frame which is made rigid and stable when extended. The height is readily extendable to suit the needs of the user and is adapted to be filled with water to permit the user to perform a variety of exercises in an environment of high resistance and low impact.

10 Claims, 2 Drawing Sheets

WATER WALKER

FIELD OF THE INVENTION

This invention relates to the field of portable aquatic exercise devices. More particularly, this invention is directed to a collapsible drum shaped exercise device which is adapted to be filled with water so as to provide an aquatic environment within which an individual can exercise.

BACKGROUND OF THE INVENTION

Various collapsible devices have been proposed which allow an individual to experience the benefits and/or enjoyments of being surrounded by an aquatic environment. For example, U.S. Pat. No. 1,075,912 discloses a collapsible bath tub wherein a lining is provided within a collapsible frame. In use, when the bath tub is filled with water, the collapsible frame is locked (e.g. with clamps) into an extended position. However, when it is desired to store or transport the bath tub, the clamps may be selectively unlocked so as to permit the collapsing of the frame.

U.S. Pat. No. 4,860,914 reveals a collapsible swimming pool. This pool comprises a plurality of nestable arcuate sections each having a bottom portion and a side wall portion. A retainer is provided for securing the bottom portions together in such a manner that the side wall portions of the arcuate sections together may form an annular side wall for the pool.

While these and similar proposed devices have generally been suitable for their intended purposes, a need still exists for a portable, collapsible, drum shaped device which is sized, configured, and arranged so as to be fillable with an aquatic medium and so as to conveniently permit an individual to exercise within an aquatic environment. It is well known that movement within an aquatic environment is accompanied by low impacts and high resistance, and therefore provides an excellent means for exercising to health conscious individuals.

SUMMARY OF THE INVENTION

The water walker is a collapsible device composed of either flexible or rigid waterproof walls supported by an external frame. The frame is composed of a series of hoops interconnected by telescopic rods or a scissors like mechanism. Each hoop is raised to a desired height and locked in place. The device is then filled with water from a hose or a shower head and a ladder is put in place for access. Alternatively, a person may step into the walker while it is in a collapsed condition, and incrementally raise the interlocking hoops as the walker is filled with water. Once inside, the exerciser may jog or simply walk in place to raise his heart rate to a level recommended to simply exercise and condition his or her cardiovasculature or to exercise injured or arthritic limbs. In addition to exercise the device may be equipped with a heater and a recirculator for whirlpool action. Upon completion of exercise, the water may be drained by opening a valve actuated by a remote pull release, the device collapsed and stored for another time. Alternatively, water may be left in the device and used repeatedly if treated with chemical agents.

DETAILED DESCRIPTION OF THE DRAWINGS

Figure 1:
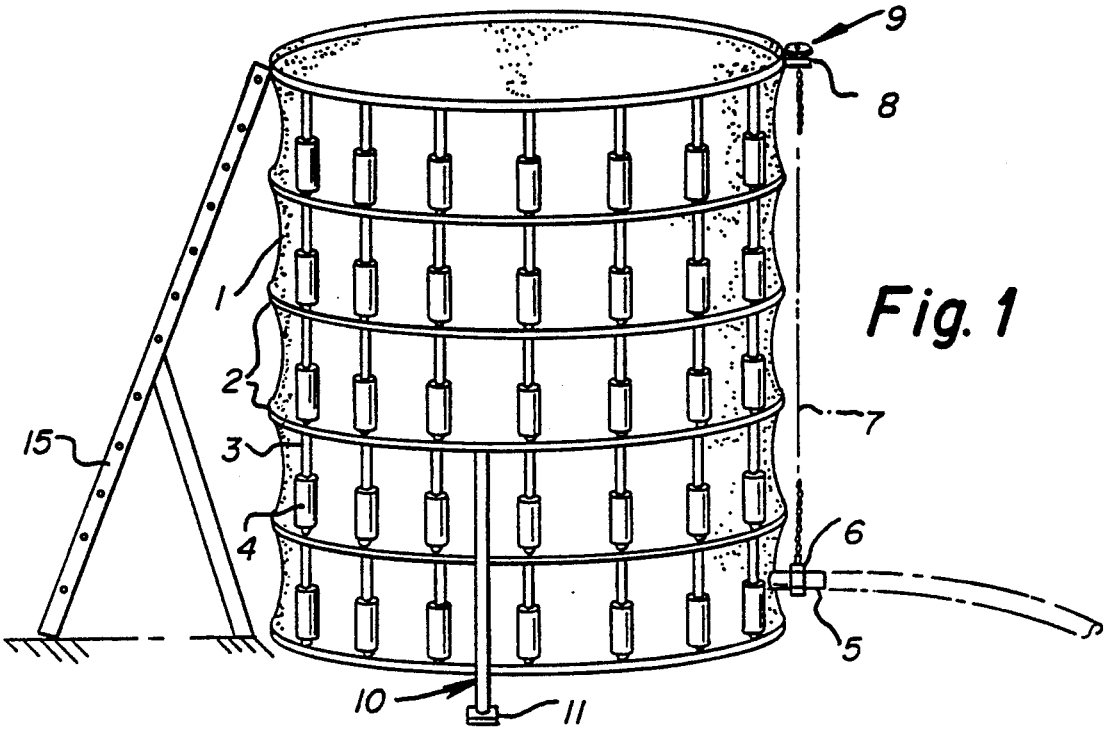
FIG. 1 shows the water walker in its upright form with its external telescoping frame and stabilizers visible.

FIG. 1 shows a generally cylindrically shaped portable embodiment of the water walker in its upright form. The water walker comprises a waterproof lining 1 having an annular vertical portion and a circular bottom portion. A plurality of hoops 2 define the diameter of the device. The hoops 2 are secured (e.g. by adhesive) to the annular vertical portion of the lining at vertically spaced locations, as shown in the Figure. Telescopically extending rods having an inner shaft 3 and an outer cylinder 4 are provided for interconnecting adjacent hoops. The telescopically extending rods are each provided with conventional automatic means (e.g. detents) for locking the shaft 3 and the cylinder 4 in their relatively extended positions. By standing within the collapsed device, the rods may be extended by gripping the hoops adjacent the bottom hoop and lifting them upward. When the rods closest to the bottom have been fully extended, they lock automatically in their extended position and the first segment of the walker is made upright. Gripping and lifting the remaining hoops in successive fashion will extend the height of the walker. If necessary, stabilizer legs 10 can be extended from the lower hoop members outward and terminate as a foot member 11. A plurality of these members may be assembled to enhance the stability of the upright walker.

In its fully extended configuration the water walker may have a height up to 6 or 7 feet. Moreover, the diameter of the hoops may be 3 feet or more.

Once extended, the water walker may be filled with water. (Alternately, the water walker may be filled as it is being extended.) The water source may comprise a shower head (if the walker is to be in a shower stall), a hose connected to a sink faucet, or other similar source. A ladder 15 may be attached to the exterior and interior of the water walker for entry and exit (a feature which is most clearly shown in FIG. 3). A belt may be secured at a position inside the water walker and may be used by exercising individuals to aid them in keeping their balance. The ladder also gives added stability to the extended water walker.

In use, when an exercising individual is positioned within the water walker and the water walker is filled with water, the individual may exercise by "walking" in place or otherwise moving against the resistance of the water. Such exercising will cause turbulence to develop in the water. However, such turbulence will generally not be sufficient to cause an overflowing or splashing of the water out of the device.

Upon completion of the exercise, if it is desirable to collapse the device and transport it elsewhere, it may be drained by way of a remotely actuated drain 5. The drain 5 is located near the bottom of the device and may be attached to a drainage hose for evacuation of the water into a household drain. A valve 6 within the drain member may be selectively opened and closed by actuating a handle 9 which is connected to the valve by way of a chain or cord 7. The manner in which the valve 6 is remotely actuated between its opened and closed positions by movement of the handle 9 is similar to the manner in which a conventional drain valve in a bathroom sink is remotely actuated by the user accessible control member provided at the top of the sink for that purpose. The handle 9 is retained by ring 8 on the upper most hoop. The location of this handle is important in that it enables the individual to open the drain without having to submerge to find an internal valve or to exit from a full tank of water. If, however, the user wishes to use the device again without draining and refilling, he may simply exit using ladder 15. The ladder 15 for the water walker extends both internally and externally of the hoops 2.

Although the telescoping rods have been depicted in FIG. 1 as each comprising two main sections (e.g. the shaft and the cylinder), it is envisioned that each rod could comprise more than two telescopic sections. For example, each rod may comprise a shaft, an intermediate sleeve, and a cylinder which are normally disposed one inside the other, but which are extendable (much like a portable radio antenna) and lockable at their fully extended positions. The means for locking the sections in their fully extended positions may comprise a conventional spring loaded detent (e.g. a ball detent) which "clicks" when the sections are locked in their extended positions. The spring loaded detent includes a detent member provided in one of the sections is urged outwardly by a spring into a complementary recess or annular groove formed in and presented by an adjacent section when the two sections are in their fully extended relative positions. Using such a detent, when it is desired to collapse the extended members, it will be necessary to overcome the spring force acting on the detent member by utilizing the camming action of the recess or annular grove acting thereon. This camming action is easily initiated by the individual in the water walker bearing down slightly on the extended hoops.

Figure 2:
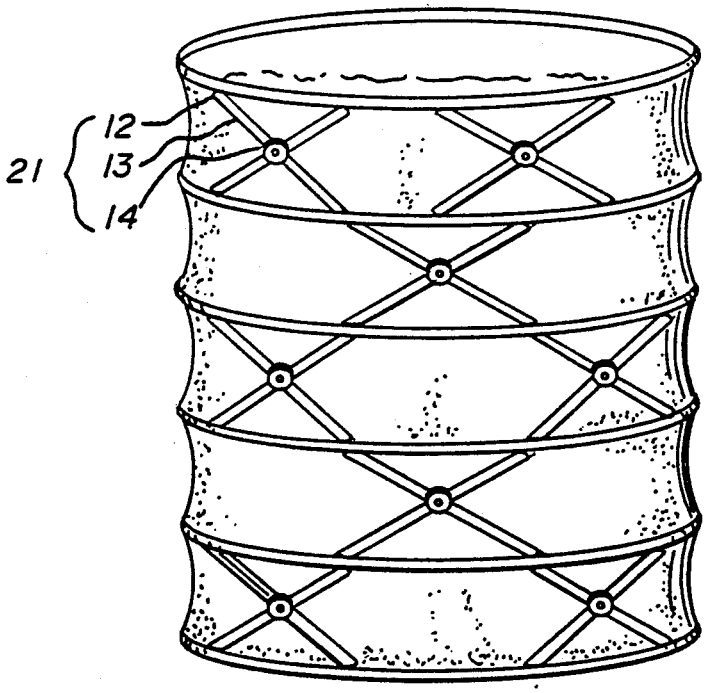
FIG. 2 shows the water walker with an external scissors frame.

FIG. 2 shows the water walker with scissors type extending members 21 replacing the telescoping rods of the FIG. 1 embodiment. The extending members 21 each comprise a pair of rod members 13. One end of each rod member 13 is provided with a reinforced footing 12. For each extending member, the reinforced footing 12 on each rod member 13 is secured to a different one of two adjacent hoops 2 surrounding the walker. A locking member 14 (comprising a conventional detent, such as described above) retains the scissors extension member in position once the hoops have been fully extended. Extension of the water walker of FIG. 2 to its full upright position is accomplished in a manner similar to that described with reference to FIG. 1. That is, hoops are locked in position one at a time (as their respective extending members 21 are fully extended) and in succession until the desired height is achieved.

Figure 3:
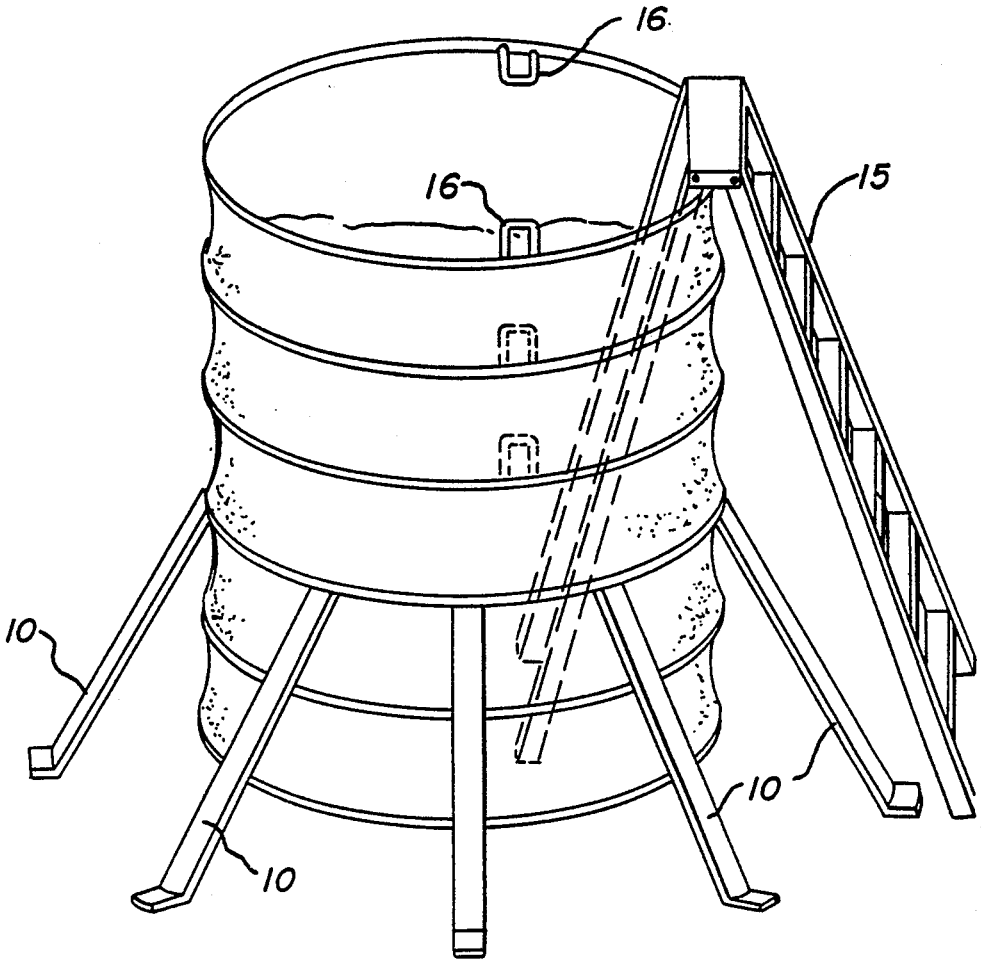
FIG. 3 shows the water walker with ladder and hand holds.

FIG. 3 reveals a water walker having the form of a drum with a length thereof greater than a diameter thereof. The water walker is provided with the stabilizers 10, ladder 15, the belt 15*a*, and internal handles 16. During the exercise the user may wish to hold onto a structure to maintain balance. Handles 16 are incorporated into and extend from each of the upper hoop portions. By positioning handles opposite each other, stability will be further enhanced as it is envisioned that the user will grip each of the two handles when "walking" in place.

Also shown in FIG. 3 is a water heater WH which may be employed for raising the temperature of the water entering the water walker if a suitable source of hot water is not otherwise available. The conventional water heater WH is of the flow through, or "flash" as it is sometimes called, type and may be conveniently powered by household electricity. Of course, with this arrangement, an individual who is inside the water walker may terminate the flow of hot water by operating a nozzle provided at the end of the hose leading from the water heater to the water walker. (Alternatively, the water walker may be provided with a heater system for heating and circulating water within the walker. Similar heater systems have been employed in conjunction with hot tubs and spas for years. Still alternately, a hot water storage tank may be provided near the water walker for providing hot water to the water walker upon demand.)

Figure 4:
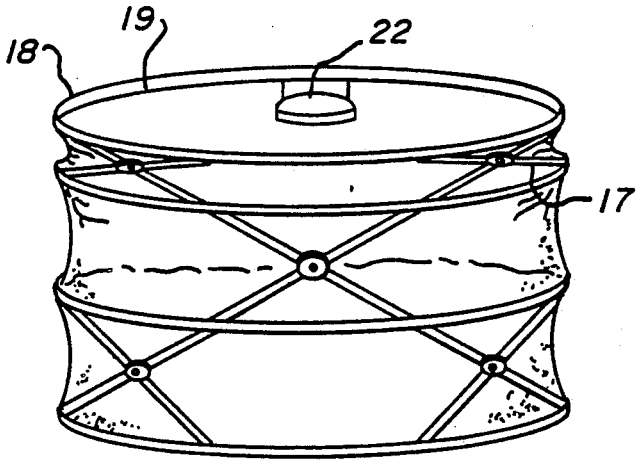
FIG. 4 shows the water walker in a partially collapsed form.

FIG. 4 shows a portion the water walker in a collapsed condition. Scissors members 21 are seen collapsed between the second and third hoops. In this condition, only a minimal space 17 exists between these two hoops and the liner becomes folded upon itself within the tank. A seat member 22 extends from the inside of the device and may be retained by hooking members engaging the hoops. Alternatively, a seat may be molded to and extend from an internal portion of the liner.

The liner itself is composed of a waterproof material and is, in the preferred embodiments of the Figures, flexible. However, it is equally envisioned that a non-collapsible water walker may be manufactured with a rigid lining. Acrylic is envisioned as the material of choice for the rigid embodiment. If the flexible liner is used, a variety of waterproof materials may be utilized, including reinforced polymers. Suitable waterproof materials are known and are characterized by light weight, high strength and high durability. The material of the liner may also be textured so as present a non-slip surface for the exercising individual to stand on. (The non-slip surface, in conjunction with the safety belt and handles described above, will ensure that the water walker provides a safe and risk free environment for any individual who desires to enjoy the benefits of aquatic exercise.) The rigid or flexible liner may be attached as necessary to the surrounding extensible frame to promote ease of erection, use, drainage, and storage.

The water walker may have any shape which facilitates and is conducive to the exercising of the individual. The water walker will, however, usually be characterized by having a height dimension which is greater than its width (e.g. diameter) dimension. If designed for use by children, the overall dimensions of the assembled walker might not exceed 3–4 feet in height and 3 feet in diameter. An adult sized walker would be considerably larger, and may be elliptical in cross section to accommodate a complete range of motion for extended limbs.

The frame members can be conveniently constructed of light gauge tubular metal or reinforced plastic tubing. The tubing joints and other connections in the frame can be made similar to those in other well known light weight frame systems, i.e. in the portable tent art, portable baby crib art, foldable chair art, etc. Wooden frame members might also be used; however, a wooden water walker might be heavier and therefore less portable than one made with metal or plastic frame members.

In the preferred described embodiments, the hoops of each water walker all have the same diameter. However, this is not a necessary requirement, and it is envisioned that water walkers will be constructed wherein the diameters of the hoops become smaller at higher heights thereof. Such a construction would provide a tapered frame which would accommodate a similarly tapered lining. A tapered water walker may, in some instances, be safer and more practical than the cylindrically shaped water walkers described in the preferred embodiments.

The foregoing is a description of the preferred embodiments of the present invention, and is not intended to limit the scope thereof. The invention, therefore, will encompass the described preferred embodiments as well as any modifications thereof which will fall within the scope of the appended claims.

I claim:

1. A device for permitting an individual to exercise within an aquatic environment comprising:

collapsible vessel means for containing a fluid;

the vessel means opening upwardly and adapted for filling the vessel means through the opening;

a fluid outlet at a bottom portion of the vessel means;

the fluid outlet comprising valve means for controlling a flow of the fluid through the fluid outlet; the valve means being selectively actuated between a first position permitting the fluid to flow out of the vessel means and a second position preventing the fluid from flowing out of the vessel means; and actuating means for operating the valve means, the actuating means being remotely located from the valve means;

wherein the vessel means comprises a waterproof liner supported by a frame; and wherein the frame is provided with extendable means for adjusting the volume of the vessel.

2. A device as recited in claim 1 wherein the frame comprises a plurality of collimated hoop members connected together by the extendable means.

3. A device as recited in claim 2 wherein the extendable means comprise a plurality of telescoping members, each of the telescoping members including first and second telescoping sections which are respectively connected to adjacent ones of the hoop members, the first and second telescoping sections adapted to be lockable together.

4. A device as recited in claim 2 wherein the extendable means comprise a plurality of scissors members, each of the scissors members including first and second scissors elements which are pivotally connected to one another and extend between adjacent ones of the hoop members.

5. A device as recited in claim 1 wherein the frame further comprises external stabilizing legs.

6. A device as recited in claim 1 wherein the liner is textured so as to provide the vessel with a non-slip internal surface.

7. A device as recited in claim 1, wherein the vessel means comprises a side wall, and the side wall is generally cylindrical in cross-sectional shape.

8. A device as recited in claim 7, wherein a height of the vessel means is greater than a width thereof.

9. A device for permitting an individual to exercise within an aquatic environment comprising:

collapsible vessel means for containing a fluid;

the vessel means comprising an open top portion which permits filling of the vessel means from the top portion;

a fluid outlet at a bottom portion of the vessel means;

the fluid outlet comprising valve means for controlling a flow of fluid through the fluid outlet; the valve means being selectively actuated between a first position permitting fluid to flow out from the bottom portion of the vessel means and a second position preventing fluid to flow out from the bottom portion of the vessel means;

actuating means provided adjacent the top portion of the vessel means for operating the valve means;

handles provided within the vessel means and adapted to permit an individual in the vessel means to hold on while exercising; and external stabilizing legs connected to the vessel means for stabilizing the vessel means.

10. A device as recited in claim 9, wherein the vessel means comprises a drum having one open end, and wherein a length of the drum is greater than a diameter thereof.

* * * * *